US006328571B1

(12) United States Patent
Dricken et al.

(10) Patent No.: US 6,328,571 B1
(45) Date of Patent: Dec. 11, 2001

(54) WALL MOUNTED RAIL SYSTEM WITH MOVABLE BOARDS

(75) Inventors: Dennis J. Dricken, West Bend; Michael A. Niver, Plymouth, both of WI (US); Shawn O. Barrett, Grayslake; Paul Bond, Chicago, both of IL (US); Matt J. Alles, Kewaskum, WI (US)

(73) Assignee: Bretford Manufacturing Inc., Franklin Park, IL (US)

( * ) Notice: Subject to any disclaimer, the term of this patent is extended or adjusted under 35 U.S.C. 154(b) by 0 days.

(21) Appl. No.: 09/327,364

(22) Filed: Jun. 4, 1999

(51) Int. Cl.[7] ..... B43L 1/00
(52) U.S. Cl. ..... 434/408; 434/414
(58) Field of Search ..... 434/408, 413, 434/414, 419, 420, 211; 52/64

(56) References Cited

U.S. PATENT DOCUMENTS

| | | | | |
|---|---|---|---|---|
| 627,396 | * | 6/1899 | Daly | 434/421 |
| 2,655,740 | * | 10/1953 | Goodrich | 434/414 |
| 3,363,871 | * | 1/1968 | Slazik et al. | 434/421 |
| 3,731,335 | * | 5/1973 | Chrisp | 434/408 |
| 3,810,330 | | 5/1974 | Daggy . | |
| 6,018,915 | * | 2/2000 | Pomish et al. | 52/64 |

FOREIGN PATENT DOCUMENTS

| | | |
|---|---|---|
| 685799 | 10/1995 | (CH) . |
| 685913 | 11/1995 | (CH) . |
| 0145018 | 6/1985 | (EP) . |
| 0565039 | 10/1993 | (EP) . |

* cited by examiner

*Primary Examiner*—Sam Rimell
(74) *Attorney, Agent, or Firm*—Wood, Phillips, VanSanten, Clark & Mortimer

(57) ABSTRACT

A wall mounted rail system with movable boards comprises a pair of elongate rails. Each rail has an upwardly opening channel defining an upper track and a downwardly opening channel defining a lower track, the rails being horizontally mounted in parallel spaced apart relationship on a wall surface so that one of the rails defines an upper rail and the other rail defines a lower rail. The board is movably mounting to the rails. An upper bracket is secured to a top of the board and has a guide element received in the upper track of the upper rail. A lower bracket is secured to a bottom of the board and has a guide element received in the lower track of the lower rail.

9 Claims, 10 Drawing Sheets

36
20
15
27
202
28
200
202
194
126
54
8
38
136
136
134
194
30
40
134
202
146
130
124
130
15
136
202
200
136
40
43
128
190

20
194
214
220
27
216
220
8
212
28
214
40
194
210
214
52
30
218

WALL MOUNTED RAIL SYSTEM WITH MOVABLE BOARDS

FIELD OF THE INVENTION

The present invention relates to wall mounted rail systems and, more particularly, to a modular wall mounted rail system used with movable boards.

BACKGROUND OF THE INVENTION

Businesses, academic institutions, and the like have often used wall mounted boards and panels for aiding in presentations. These needs have been satisfied by using chalk boards, dry erase boards, bulletin boards and projection screens. Originally, any of these boards were fixedly mounted to a wall. This limited how and where the board could be used to provide efficient viewing.

More recently, wall systems have been used in which a track is fixed to a wall. Boards of the type described above were suspended downwardly from the track. In some cases, the board could slide along the track. This allowed the boards to be taken down when not needed, moved from room to room, or moved to a different position within a room more easily. Such wall systems, while more flexible might require removal of the board from the track for repositioning. Also, for storage each board had to occupy its own position along the wall or be removed and stored separately.

The present invention is directed to improvements in wall mounted systems for use with movable boards.

SUMMARY OF THE INVENTION

In accordance with the invention a modular wall mounted system includes movable boards with improved rollers and guiding of the boards on a rail system. The wall mounted system also includes an improved balancing tilt mechanism for mounting a projection screen to the rail system.

Broadly there is disclosed a wall mounted rail system with movable boards comprising a pair of elongate rails. Each rail has an upwardly opening channel defining an upper track and a downwardly opening channel defining a lower track, the rails being horizontally mounted in parallel spaced apart relationship on a wall surface so that one of the rails defines an upper rail and the other rail defines a lower rail. Means are provided for movably mounting a board to the rails comprising an upper bracket secured to a top of the board and having a guide element received in the upper track of the upper rail and a lower bracket secured to a bottom of the board and having a guide element received in the lower track of the lower rail.

It is a feature of the invention that the upper bracket guide element comprises a roller and the lower bracket guide element comprises a guide pin.

It is another feature of the invention that the mounting means comprises a tilt mechanism for adjusting an angle of the board relative to the wall surface.

It is still a further feature of the invention that the tilt mechanism includes means for balancing the board at any angle of tilt. The balancing means comprises a spring operatively connecting the board to the mounting means and means for frictionally connecting the board to the mounting means.

In accordance with another aspect of the invention the board comprises an outer board and further comprising an inner board, and means for movably mounting the inner board to the rails comprising an upper guide element received in the lower track of the upper rail and a lower guide element received in the upper track of the lower rail so that the inner board moves independently of the outer board. The upper guide element comprises a guide pin. The lower guide element comprises a roller.

It is yet another feature of the invention that the roller comprises an inner roller surrounded by a roller shell and the roller shell is rotatable independently of the inner roller. The inner roller contacts a horizontal surface of the track and the roller shell contacts a vertical surface of the track so that the roller shell tends to spin in a direction opposite the inner roller.

DETAILED DESCRIPTION OF THE INVENTION

Figure 1:
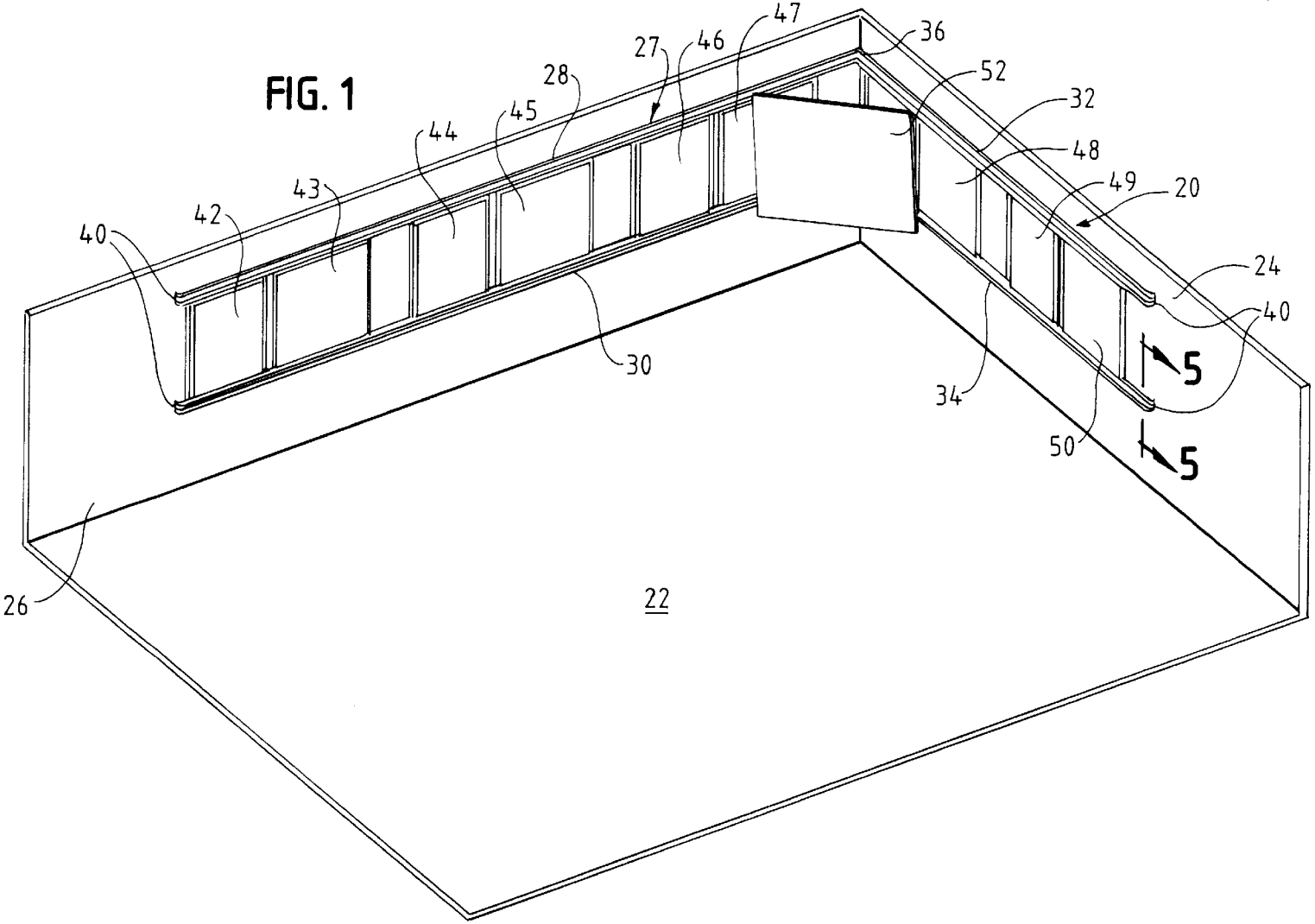
FIG. 1 is a perspective view of a wall mounted rail system with movable boards in accordance with the invention.

Referring initially to FIG. 1, a modular wall mounted system 20 with movable boards in accordance with the invention as illustrated. The system 20 is shown mounted in a room 22 having a front vertical wall 24 and a side vertical wall 26. In accordance with the invention, the system 20 can be custom installed in virtually any room, regardless of size. The system allows boards to be moved to virtually any position in the room, including around corners of the room, without removing the boards. The illustration of the system 20 in FIG. 1 is but one example of a configuration.

The system 20 includes a rail system 27 including an upper rail assembly 28 and a lower rail assembly 30 mounted in parallel, horizontally along the side wall 26.

Similarly, an upper rail assembly 32 and lower rail assembly 34 are mounted in parallel horizontally along the front wall 24. The upper rail assemblies 28 and 32 are connected at an upper corner assembly 36. The lower rail assemblies 30 and 34 are similarly connected with a lower corner assembly 38, see FIG. 2. Plastic molded end-caps 40 are connected at the distal ends of the rail assemblies 28, 30, 32 and 34.

The length of the rail assemblies 28 and 30 are identical along the side wall 26. Similarly, the lengths of the rail assemblies 32 and 34 are identical. The vertical spacing between the upper rail assemblies 28 and 32 and the lower rail assemblies 30 and 34 is selected according to the height of movable boards to be used therewith. Likewise, the rail assemblies 28, 30, 32 and 34 can be placed at any desired vertical position along the walls 26 and 24 as necessary for viewing requirements.

The system 20 includes different configurations of boards. These include inboard mount boards 42, 43, 44, 45, 46, 47, 48, 49 and 50. Each of the boards 42–50 can be moved to any position along the rail system 27. Also, as described below, the rail system 27 includes inner and outer tracks for mounting the inboard mount boards 42–50 so that two boards can be mounted at any particular position along the rail system 27. For example, the first board 42 is on the inner track, while the second board 43 is on the outer track. A board can be easily moved between an outer track and an inner track and the board can be turned 180° on either track. Thus, a board might be, for example, a dry erase board on one side and a fabric or cork board on the other side.

Figure 2:
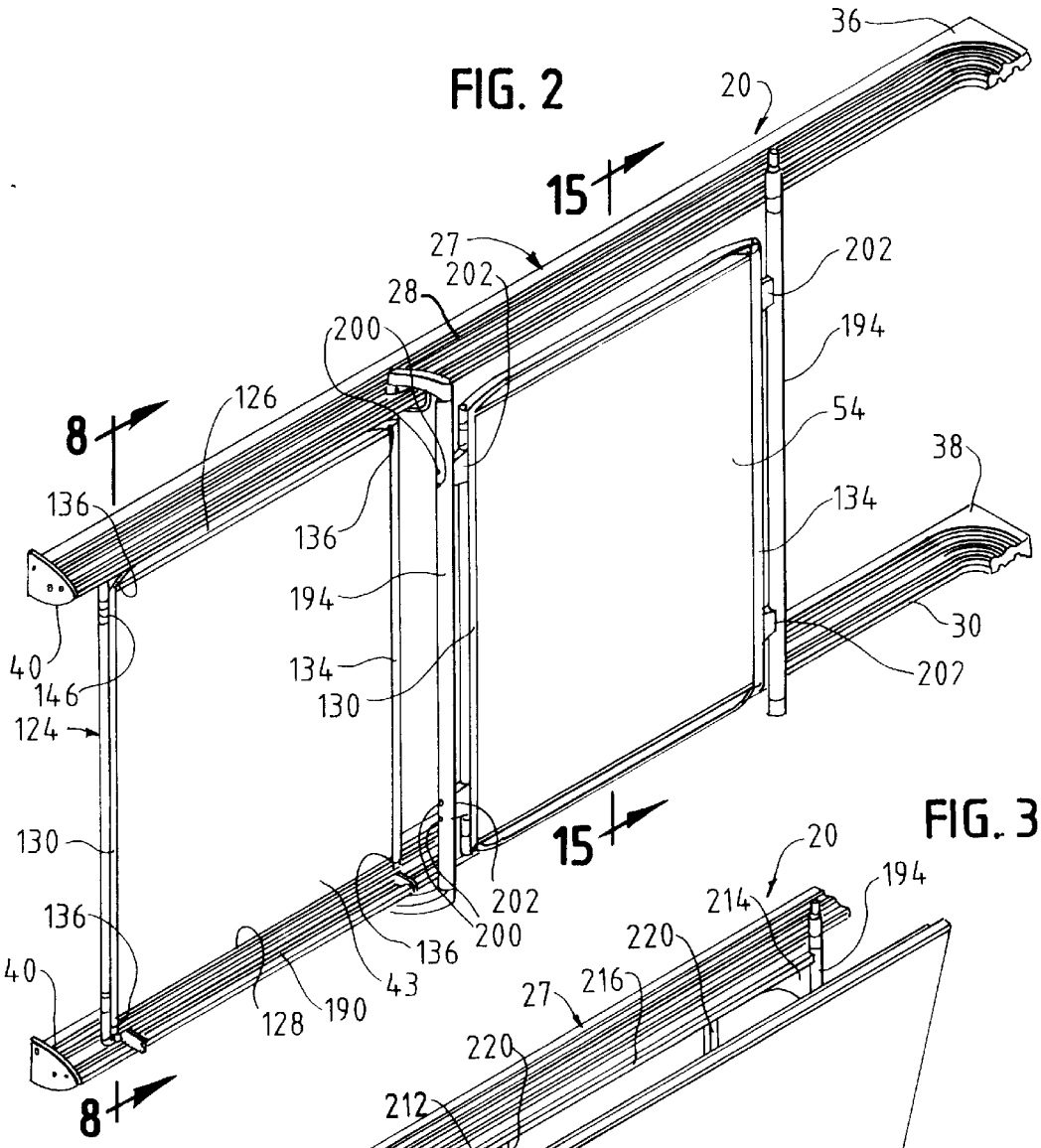
FIG. 2 is a more detailed perspective view of the portion of the wall system of FIG. 1.

Also shown mounted to the rail system 20 of FIG. 1 is a projection screen assembly 52 which can also be moved to any position on the rail system 27. FIG. 2 also illustrates an outboard mount board 54 in accordance with the invention.

In accordance with the invention, each of the rail assemblies 28, 30, 32 and 34 is identical in construction. Thus, a single type of rail assembly is utilized. The rail assembly is sized or cut to a desired length. A pair of rail assemblies are mounted in parallel, as described above, at a particular location on a wall. The relative location determines if the rail assembly is being used as an upper rail assembly or a lower rail assembly.

Figure 4:
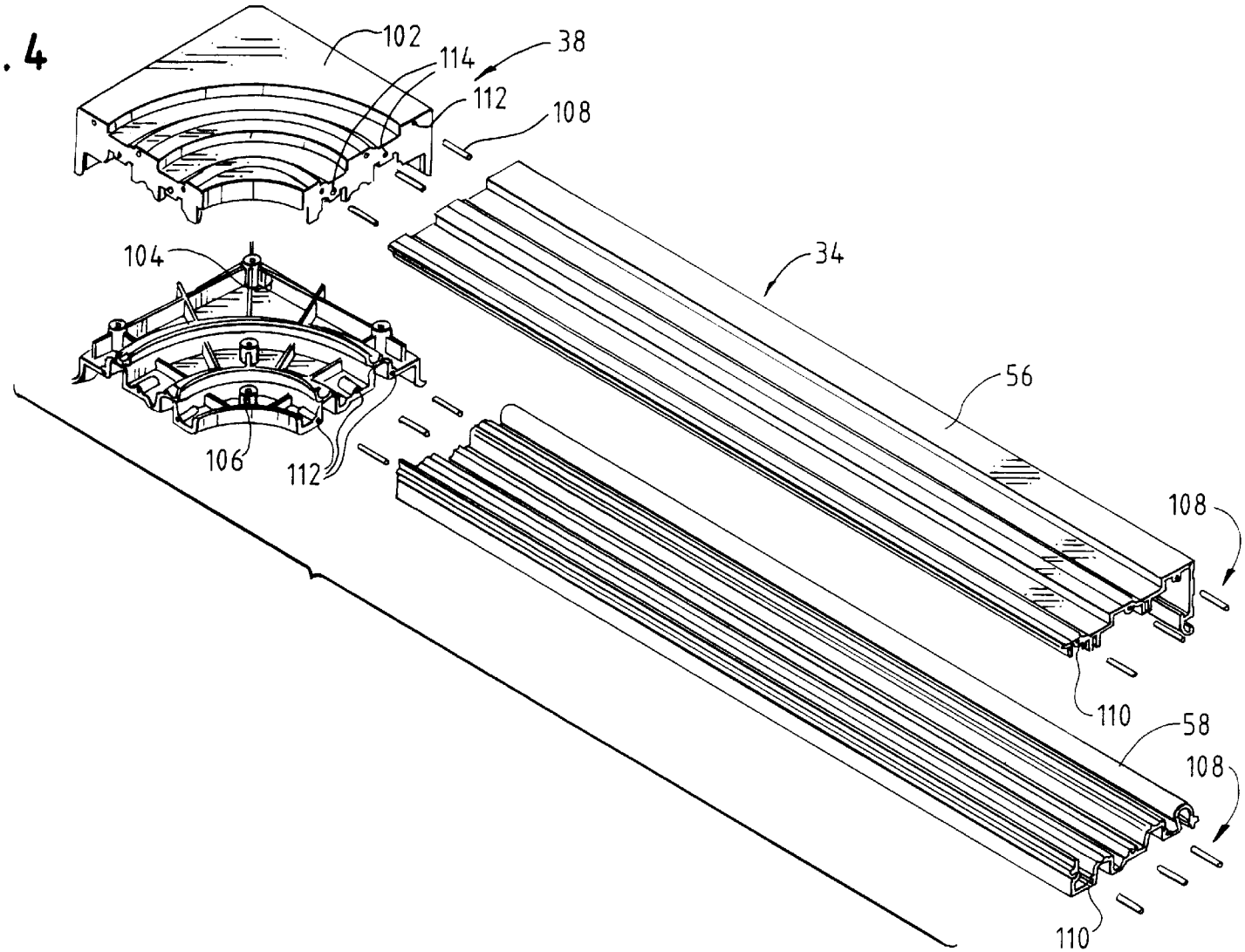
FIG. 4 is an exploded view illustrating a portion of the rail system in accordance with the invention.
Figure 5:
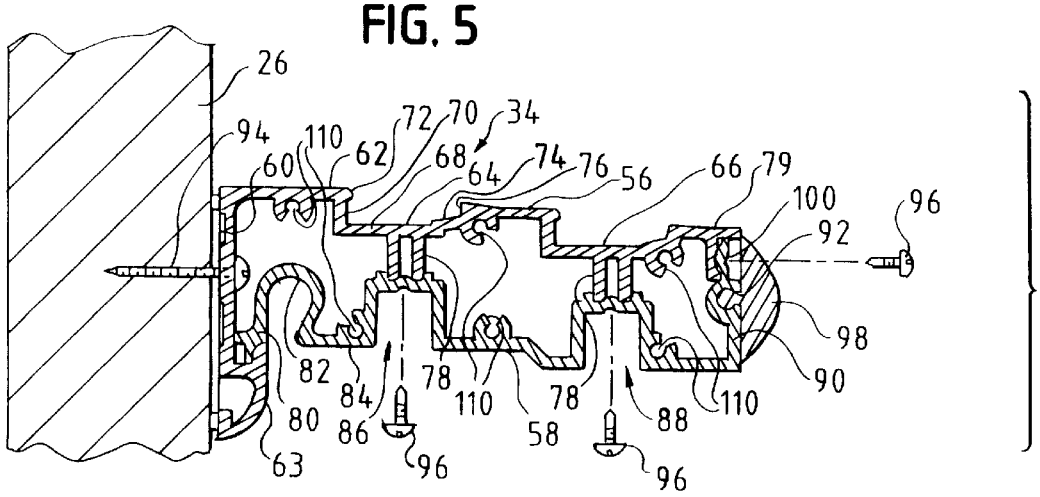
FIG. 5 is a sectional view taken along the line 5—5 of FIG. 1.
Figure 6:
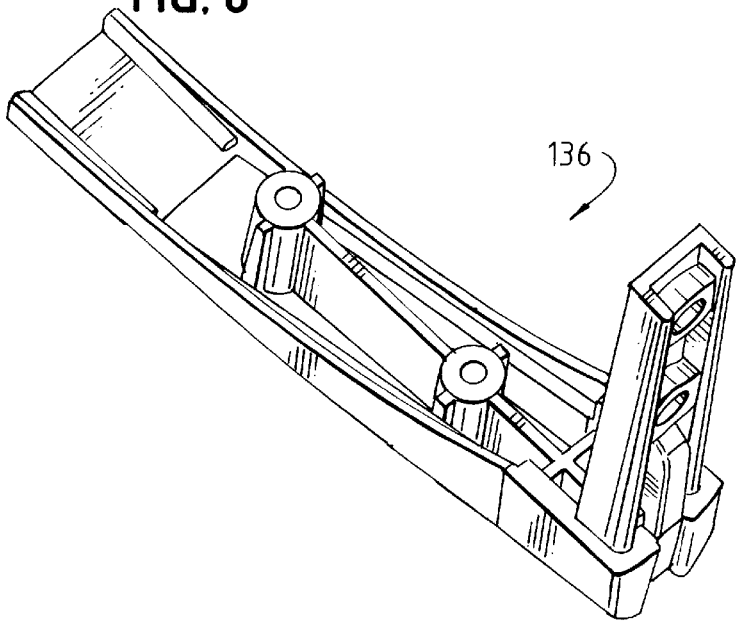
FIG. 6 is a perspective view of a corner bracket used with the boards of the system of FIG. 1.
Figure 7:
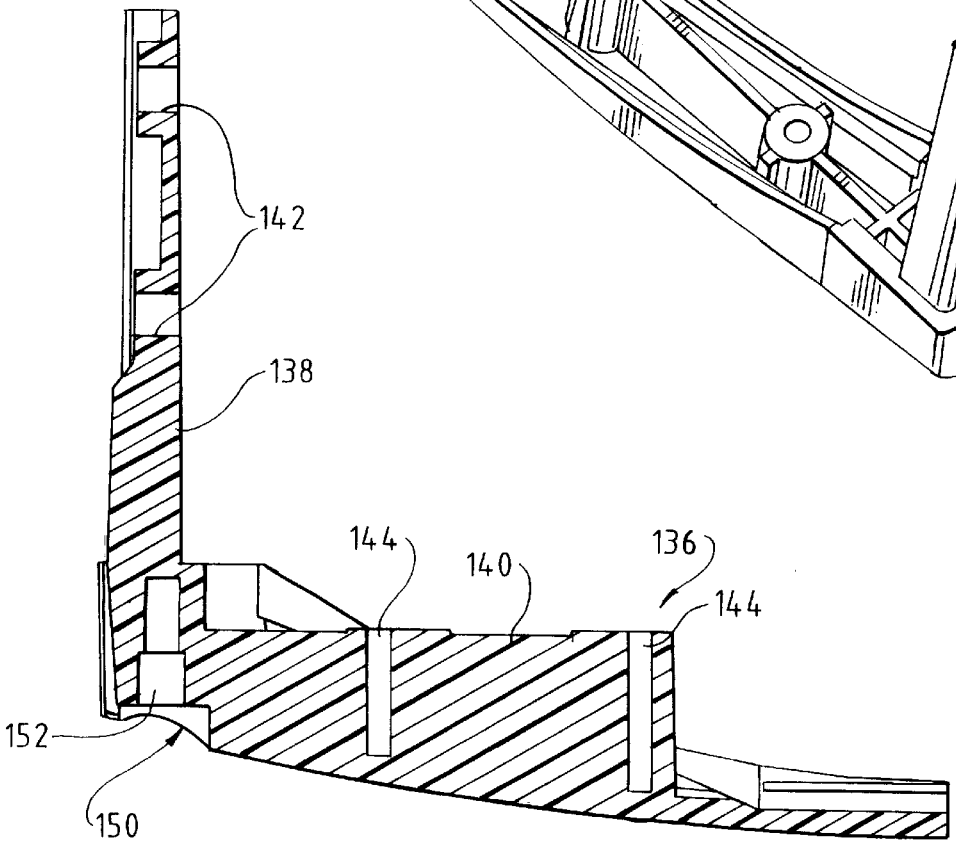
FIG. 7 is a sectional view of the bracket of FIG. 6.

Referring to FIG. 4, the lower rail assembly 34 for the front wall 24 is illustrated in exploded view. FIG. 5 illustrates the lower rail assembly 34 in sectional view. Because the rail assemblies 28, 30, 32 and 34 are identical in construction, uniform numbering is utilized herein for the specific elements of any of the rail assemblies 28, 30, 32 and 34.

The rail assembly 34 includes an upper rail 56 and a lower rail 58. Each rail 56 and 58 comprises an elongate aluminum extrusion. As is apparent, the rails 56 and 58 could be formed other than by extrusion and of materials other than aluminum.

The upper rail 56 includes a vertical flange wall 60 connected between an upper wall 62 and a lower projection 63. The upper wall 62 includes laterally spaced upwardly opening channels defining an inner track 64 and an outer track 66. The inner track 64 is defined by a horizontal bottom wall 68 connected to a vertically extending rear wall 70 having an upper lip 72. The bottom wall is connected at its front edge to an angled portion 74 connected to a vertical front wall 76. The front track 66 is generally similar in construction. A channel 78 extends downwardly beneath each track 64 and 66. A T-shaped wall 79 extends forwardly of the outer track 66.

The bottom rail 58 includes a rear connecting member 80 for mating with the upper rail lower projection 63. The rear member 80 is connected via a rounded channel 82 to a lower wall. 84. The lower wall 84 includes a pair of laterally spaced downwardly opening channels defining inner and outer tracks 86 and 88. The inner track 86 is at a lateral position corresponding to the upper rail inner track 64, while the outer track 88 is at a lateral position corresponding to the upper rail outer track 66. A front flange 90 extends upwardly from the bottom wall 84 and includes a dovetail groove 92 centrally located therein.

To mount the rail assembly 34 on a wall, such as the wall 24, the upper rail 56 is positioned at a desired location along the wall 24 and fastened using screws, such as the screw 94 at select longitudinally spaced locations along the flange wall 60. The bottom rail 58 is then mounted to the upper rail 56 by inserting the connecting member 80 in the projection 63 and pivoting the lower rail 58 upwardly until the lower tracks 86 and 88 abut the downwardly facing channels 78. Self drilling screws 96 are used to fasten the rails 56 and 58 together. Particularly the screws 96 are screwed in through the lower tracks 86 and 88 into the channels 78 and through the front wall 90 above the dovetail groove 92 into the leg of the T-shaped wall 79. This construction conceals the screws 94 between the rails 56 and 58. These screws 96 within the tracks 86 and 88 are concealed from front view. The screw 96 mounted through the front wall 90 is concealed with an elongate vinyl T-mold 98 fastened to the groove 92.

To facilitate installation, the upper and lower rails 56 and 58 are initially held together due to interlocking shoulders 100 between the front wall 90 and the leg of the T-shaped wall 79 that provides a snap fit when the lower rail 58 is pivoted upwardly.

Referring specifically to FIG. 4, the corner assembly 38, which is identical to the corner assembly 36, see FIGS. 1 and 2, includes an upper corner piece 102 and a lower corner piece 104. These corner pieces 102 and 104 are of molded construction and are adapted to include tracks which match up to the rail assemblies to provide a 90° turn. Five screws, not shown, extend through bosses 106 of the lower corner piece 104, for securing the lower corner piece 104 to the upper corner piece 102. Connector pins 108 are used at joints between the rail assembly 34 and the corner assembly 38, and also between adjacent rail assemblies. The connector pins are inserted in circular grooves 110, see also FIG. 5, of the rail assembly 34. In the corner assembly 38 the pins 108 are inserted in openings 112. Self tapping screws from inside the upper corner piece 102 extend through openings 114 and are received in the upper rail channels 78 to pull the upper rail 56 tight to the plastic upper corner piece 102.

In accordance with the invention, the various rail boards 42–50 and 54 utilize uniform construction. FIG. 2 illustrates the inboard mount rail board 43 and the outboard mount rail board 54. These boards 43 and 54 are similar, except for the means used for mounting to the rail assemblies 27.

Figure 12:
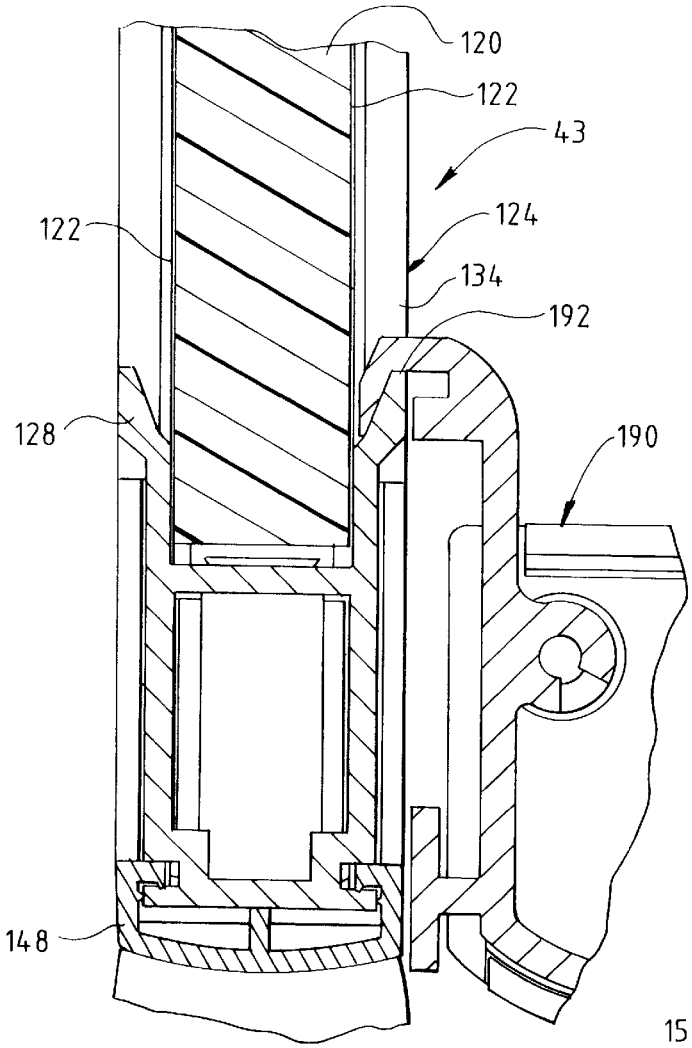
FIG. 12 is a sectional view, similar to FIG. 10, illustrating mounting of a pencil tray to a movable board.

The board 43 includes a foam center core 120 sandwiched between boards 122, see FIG. 12. The boards 122 may be, for example, porcelain or fabric or the like. The core 120 is generally rectangular and is surrounded by a frame 124, see FIG. 2. The frame 124 includes a top frame piece 126, a bottom frame piece 128, a left frame piece 130 and a right frame piece 134. Each of the frame pieces 126, 128, 130 and 134 are aluminum extrusions. The top frame piece 126 and the bottom frame piece 128 are identical in construction. The left frame piece 130 and the right frame piece 134 are identical in construction. The frame pieces are secured at each corner using molded plastic brackets 136.

As is apparent, the threaded fasteners used with the horizontal leg 140 are concealed by the core 120. The fasteners used in the vertical leg 138 are concealed using rubber bumpers 146, see FIG. 2. The bumpers 146 are snap-fit in an elongate slot in the left- and right frame pieces 130 and 134, respectively. The top and bottom pieces 126 and 128 include an elongate plastic molded trim piece 148, see FIG. 12. The trim piece 148 is color coordinated with the corner brackets 136 to provide a continuous seamless appearance at the top and bottom. The bracket 136 includes a vertical bore 150 proximate the corner having a #10–24 flanged brass insert 152 molded in place.

The board discussed above subsequently receives movable mounting means suitable for its intended use as inboard mount or outboard mount.

Figure 8:
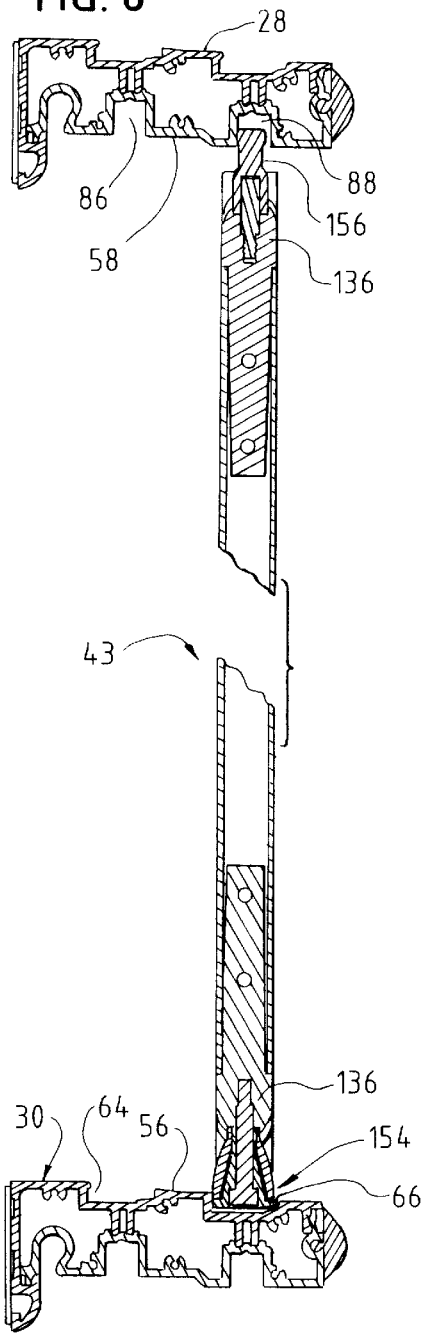
FIG. 8 is a sectional view taken along line 8—8 of FIG. 2.
Figure 9:
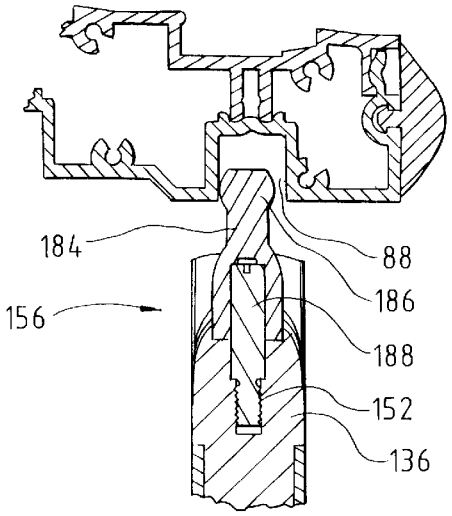
FIG. 9 is an enlarged sectional view taken at the top of FIG. 8.
Figure 10:
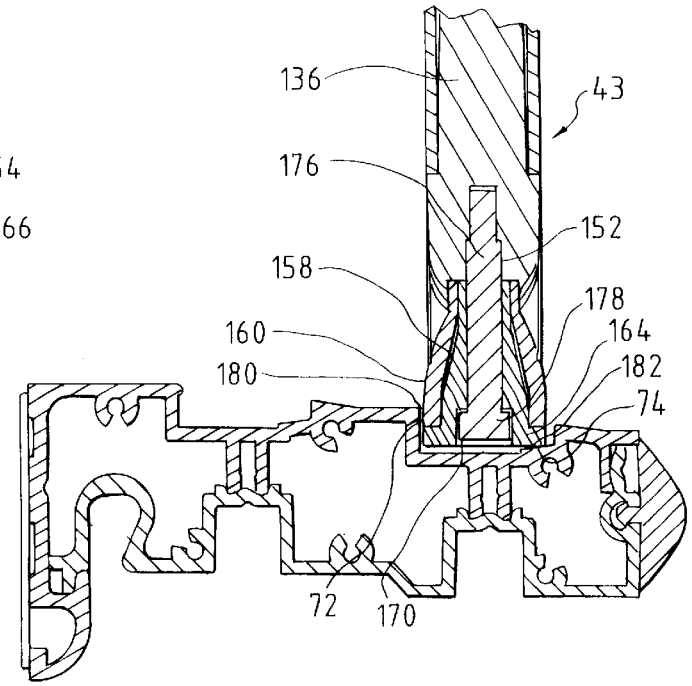
FIG. 10 is an enlarged sectional view taken at the bottom of FIG. 8.
Figure 11:
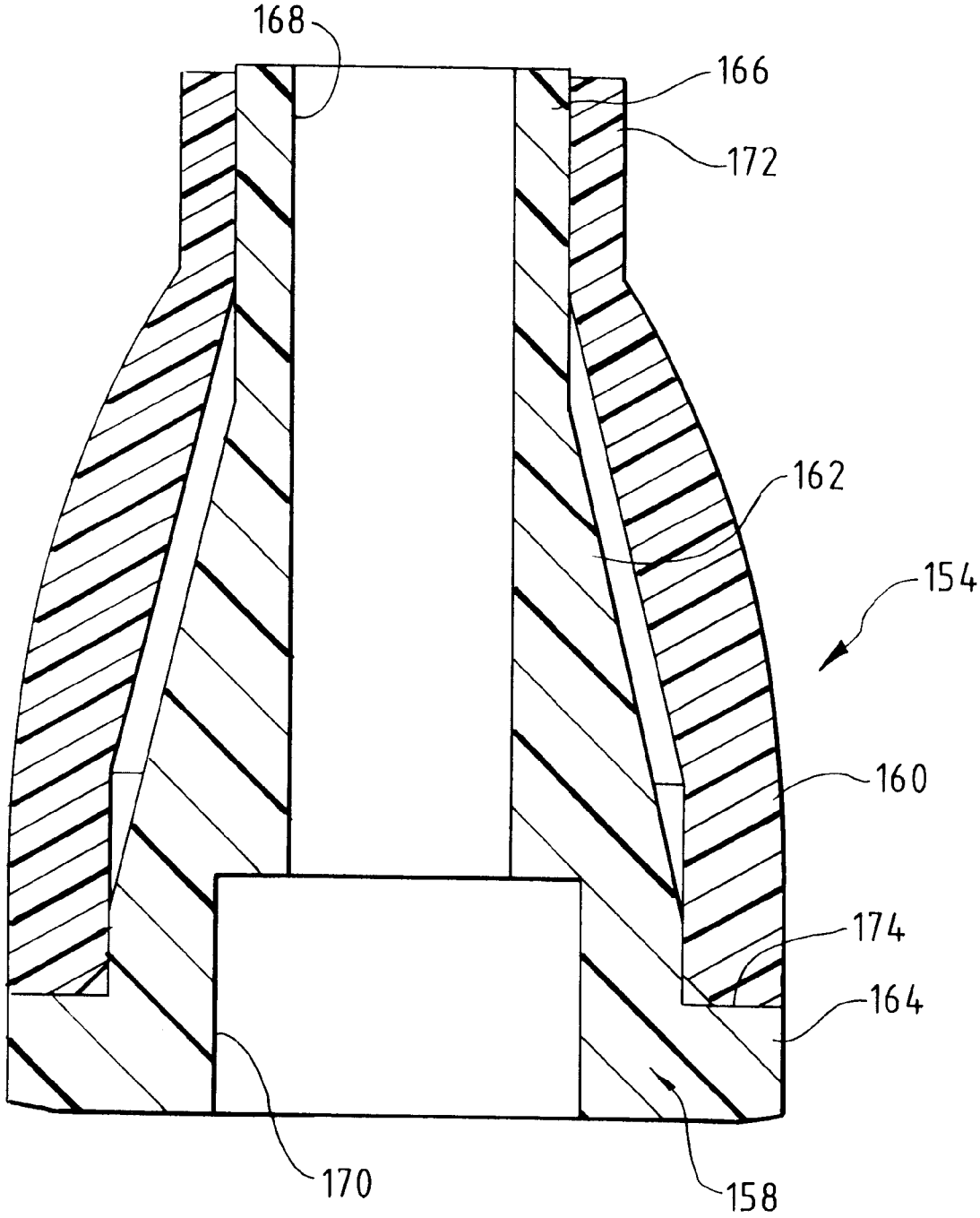
FIG. 11 is an enlarged sectional view of a roller assembly used with the system of FIG. 1.

The inboard mount rail boards 42–50 are constructed by installing roller assemblies 154 in the lower corner brackets 136 and pin assemblies 156 in the upper corner brackets 136, see FIGS. 8–10. Referring also to FIG. 11, the roller assembly 154 includes an inner roller 158 and a roller shell 160. The roller 158 and roller shell 160 are preferably formed of Delrin. The roller 158 inludes a generally central frustoconical portion 162 connected between a lower flange 164 and upper tubular portion 166. A bore 168 extends through the roller 158 with a counter bore 170 through the flange end 158. The roller shell 160 includes a tubular upper end 172 that gradually widens thereafter to a bottom edge 174. The shell 160 contacts the roller 158 at and proximate the flange 164 and at the tubular portion 166. Referring to FIG. 10, a shoulder bolt 176 extends upwardly through the bore 168 and is threaded into the bracket brass insert 152. The bolt 176 includes an enlarged head 178 received in the counter bore 170.

The roller shell 160 contacts the track lip 72 at a contact point 180. The roller flange 164 contacts the channel angled wall 74 at a contact point 182. Thus, both the roller 158 and roller shell 160 contact the upper rail 56 to guide the board 43 as it moves along the rail 56. The roller shell 160 turns freely and independent of the roller 158 to guide the board 43 smoothly along the upper rail 56 of the lower rail assembly 30. The roller shell 160 tends to spin in a direction opposite the roller 158 because its contact point is on the opposite side of the pivot point. This provides improved movement of the board 43.

Referring specifically to FIG. 9, the pin assembly 156 comprises a pin 184 including a generally spherical head 186. A steel pin core 188 is threaded to the bracket brass insert 152 for securing the pin assembly 156 at each upper corner of the board 43. Particularly, the pin head 186 is received in one of the bottom rail tracks 86 or 88 of the upper rail assembly 28, as shown in FIG. 9, to guide movement of the board 43.

The inboard mount rail board 43 is mounted to the rail system 27 by inserting the pin assembly 156 in one of the bottom rail tracks 86 or 88 of the upper rail assembly 28, see FIG. 8, and then pivoting the board assembly 43 toward the wall until the roller assembly 154 is above the corresponding track 64 or 66 of the lower rail assembly upper rail 56 and then lowering the board 43. The board can then be moved to any desired position along the rail system 27.

Referring to FIGS. 2 and 12, the board 43 optionally includes a pencil tray 190. The pencil tray 190 comprises an aluminum extrusion having a rear hook 192 to hook onto the lower horizontal board frame extrusion 128 for easy installation and removal.

The outboard mount rail board 54, see FIG. 2, differs from the inboard mount rail board 43 in that the roller assemblies 154 and pin assemblies 156 are not directly mounted to the board. Instead, the board 54 includes a tube assembly 194 connected to each of the left and right frame extrusions 130 and 134.

Figure 13:
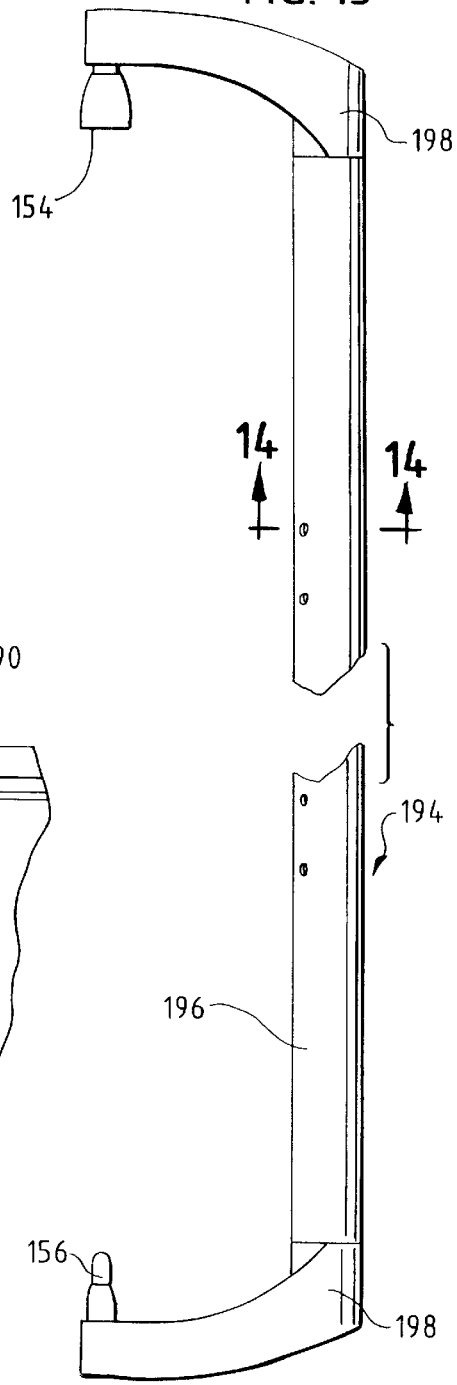
FIG. 13 is a side view of a tube assembly used with outboard mounted boards of the system of FIG. 1.
Figure 14:
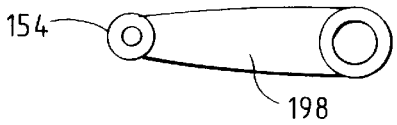
FIG. 14 is a sectional view taken along the line 14—14 of FIG. 13.

Referring to FIGS. 13 and 14, each tube assembly 194 includes an elongate extension tube 196 connected between opposite die cast corner brackets 198. A roller assembly 154 is connected to a distal end of one of the corner brackets 198 to define a top end of the tube assembly 194, while a pin assembly 156 is connected to a distal end of the opposite corner bracket 198 to define the bottom of the tube assembly 194. The corner brackets 198 are telescopically received in and connected to the extension tube 196 using threaded fasteners (not shown). The specific orientation of the corner brackets 198 depends on whether the tube assembly 194 is to be mounted proximate the left frame extrusion 130 or the right frame extrusion 134. The tube assemblies 194 are mounted to the board assembly 54 using threaded fasteners 200 inserted through spacers 202 into the respective left and right side frame extrusions 130 and 134, see FIG. 2.

Figure 15:
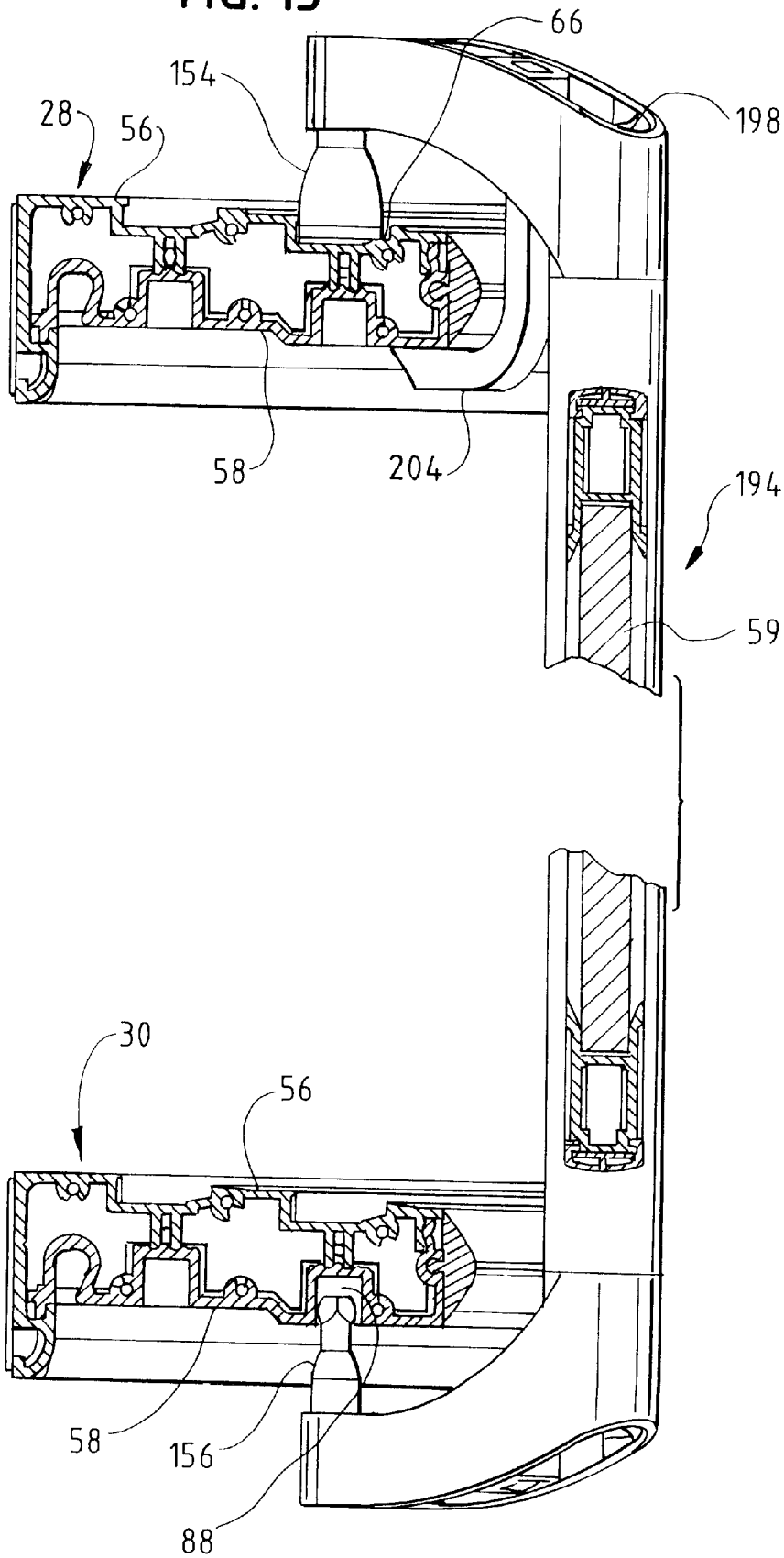
FIG. 15 is a sectional view taken along the line 15—15 of FIG. 2.

The outboard mount rail board 54 is mounted to the rail system 27 by initially inserting the pin assembly 156 in the lower rail assembly outer track 88, see FIG. 15, and then pivoting the board 54 toward the wall until the roller assembly 154 is positioned above the upper rail assembly front upper track 66 and lowered therein to the position shown in FIG. 15. An adjustable lock rod 204 is secured to the upper corner bracket 198 for thereafter preventing accidental removal of the outboard mount rail board 54.

Figure 3:
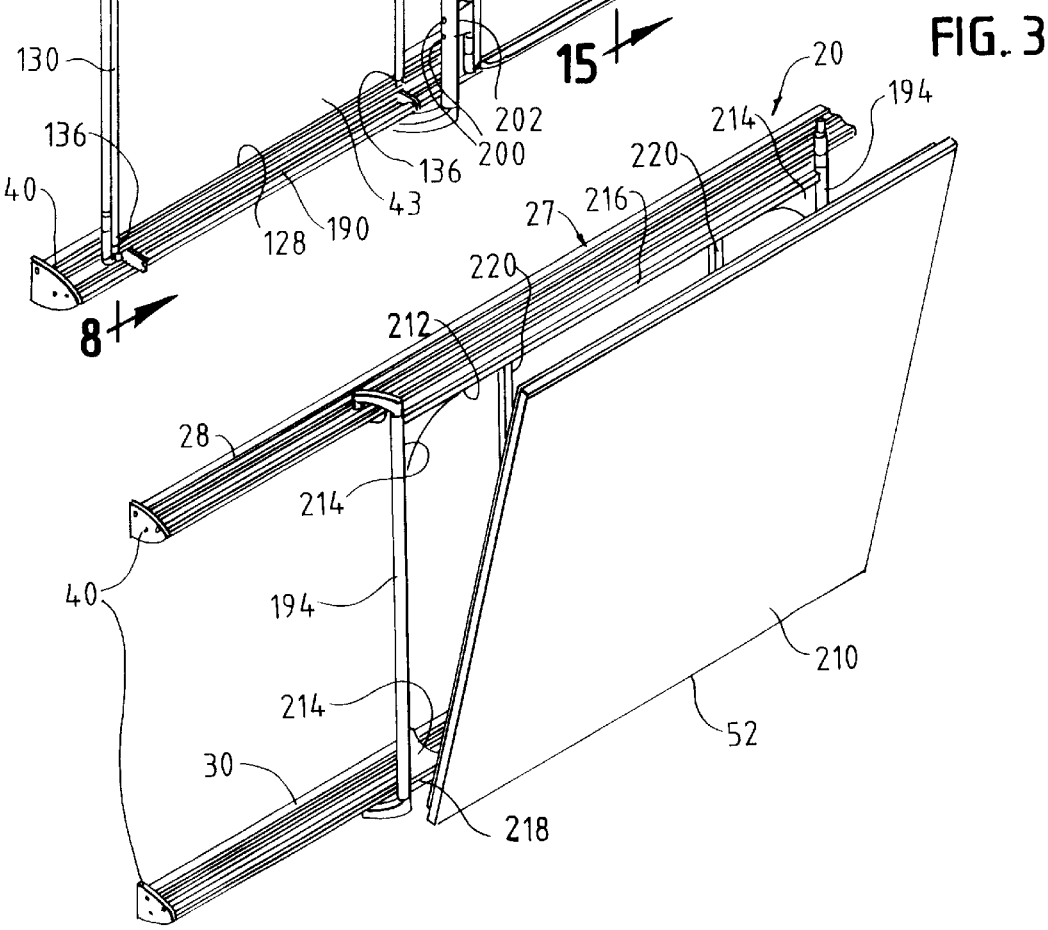
FIG. 3 is a perspective view of a portion of the system of FIG. 1 illustrating an adjustable projection screen.
Figure 16:
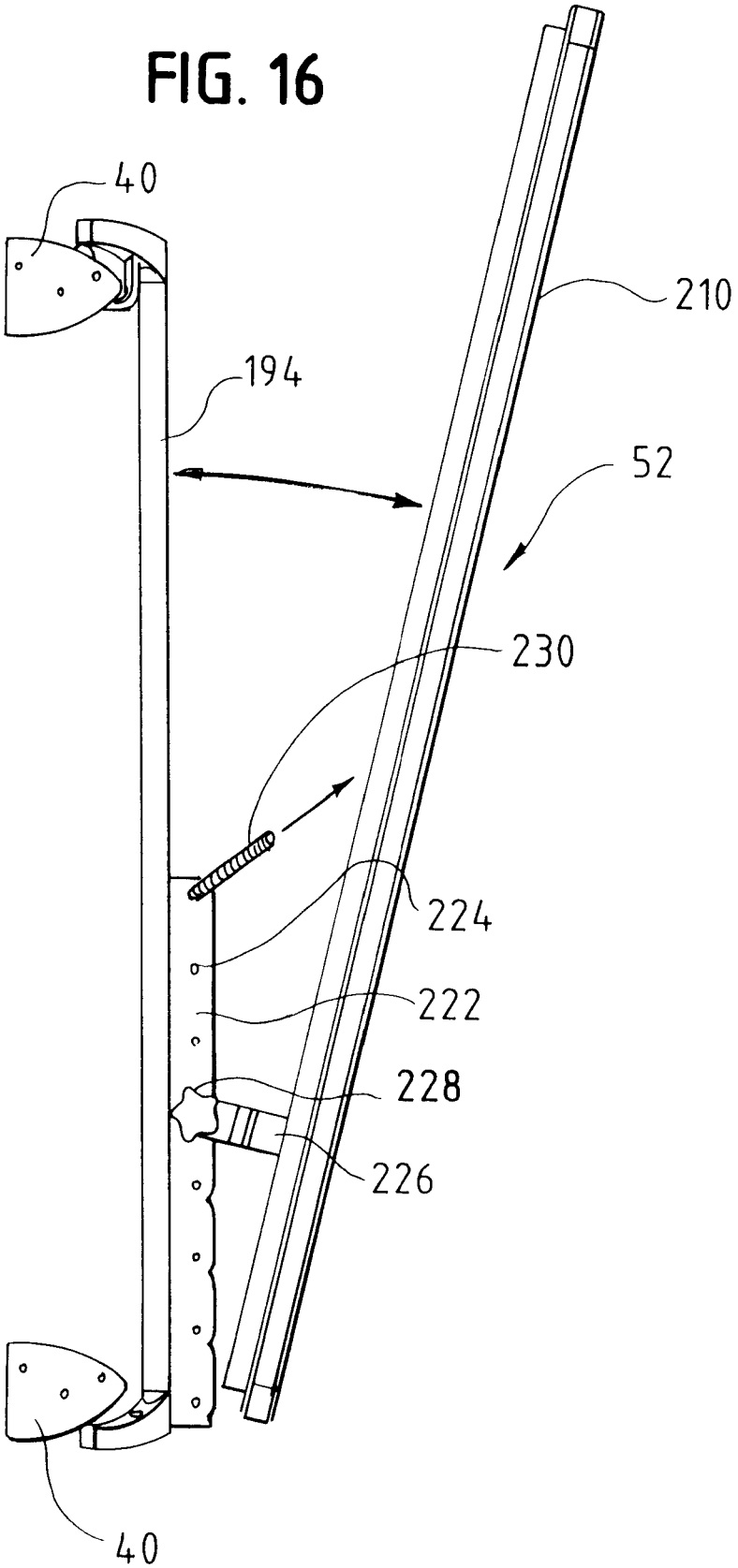
FIG. 16 is a side elevation view of the projection screen illustrated in FIG. 3.

Referring to FIGS. 3 and 16, the projector screen assembly 52 includes a board in the form of a tilting projection screen 210 adjustably connected to a frame 212. The frame 212 is in turn connected to a pair of outboard mount tube assemblies 194 using four corner brackets 214, three of which are shown. The tube assemblies 194 mount to the rail system 27 in the manner discussed above. The frame 212 includes a top bar 216 and a bottom bar 218. The top bar 216 and the bottom bar 218 are secured at opposite ends to the corner brackets 214. A pair of vertical bars 220 are secured to and extend between the top bar 216 and the bottom bar 218. The bars 216, 218 and 220 are rectangular in cross section. A plate 222 is mounted on either side of each vertical bar 220, for a total of four, proximate the lower end thereof. One of the plates 222 is illustrated in FIG. 16. The plate 222 includes a plurality of vertically spaced pivot holes 224. A pair of brackets 226 extends rearwardly from the projection screen 210 proximate a lower end thereof. One bracket 226 is provided for each vertical bar 220. A knob 228 connects each bracket 226 to one of the vertical bars 220, at a select vertical height of the plate 222. Particularly, the knob 228 includes a bolt (not shown) extending through aligned pivot holes 224 in a pair of plates 222, through an opening in the bracket 226 and is connected to a nut. Four springs, one of which is illustrated at 230, connect each plate 222 to the projection screen 210 above the bracket 226. Each spring 230 comprises an extension spring having a double loop at each end. In the illustrated embodiment to the invention, the spring 230 is approximately ⅝" in diameter and approximately 4¾" long.

In order to adjust angular orientation of the projection screen 210, the knob 228 creates friction between the brackets 226 and the plates 222 to overcome any small imbalance that the screen 210 may create. The spring 230 acts as a counterbalance to approximately balance the screen at any angle of tilt in combination with friction created by the knob 228. As will be appreciated, the knob 228 must be loose enough so that the screen 210 can be tilted, yet tight enough to create appropriate friction.

The screen 210 is illustrated in its highest position. The screen 210 can be adjusted downwardly in 3" steps by mounting in different locations of the pivot holes 224 and moving the counterbalance springs 230 similarly downwardly.

In the illustrated embodiment of the invention, the projection screen 210 is approximately 6' in height. A ballast bar can be used with a 5' screen so that it balances the same as the 6' screen and the same four counterbalance extension springs 230 can be used.

Figure 17:
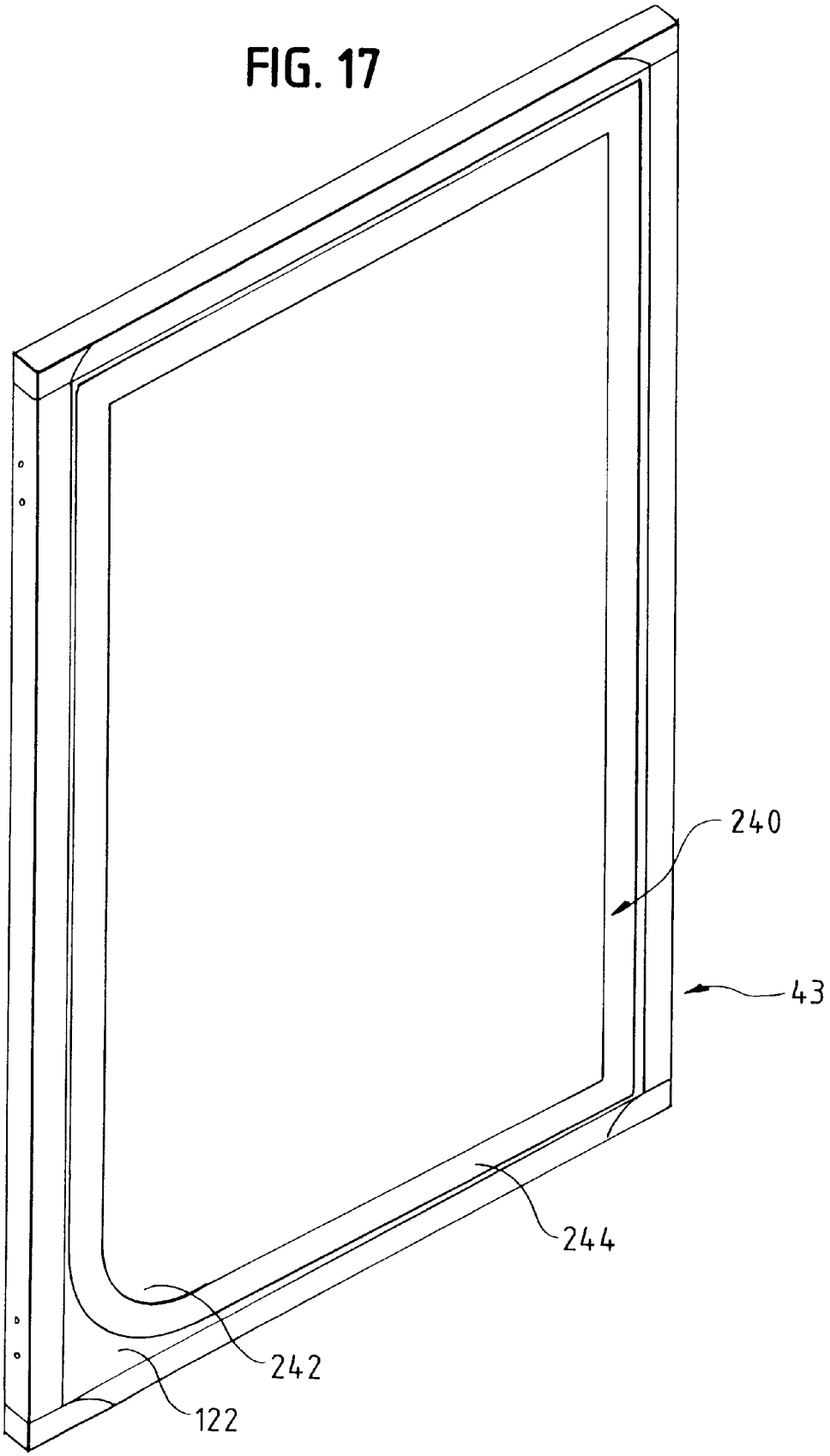
FIG. 17 is a perspective of a board including a magnetic frame mat assembly in accordance with the invention.

Referring to FIG. 17, the board 43 is illustrated with a magnetic mat holder 240. Particularly, the magnetic mat holder 240 comprises a dry erase transparent film 242 surrounded at its peripheral edge by a magnetic tape 244 for adhering to the outer board 122. Thus, a map or the like can be temporarily held in place by the mat holder 240 while remaining visible through the transparent film 242. Being a dry erase film, the film 240 can be written on and subsequently erased.

Thus, in accordance with the invention there is illustrated and described a modular wall mount system that utilizes a two piece rail system having invisible fasteners. Two inboard and one outboard mounted boards can be roller mounted between rail assemblies. The boards are mounted using a unique roller design utilizing two independent rollers. The boards are constructed using four frame extrusions secured using corner plastic pieces fastened into the extrusions. Finally, a tiltable projection screen maintains itself in any select angular position.

We claim:

1. A wall mounted rail system with movable boards comprising:

a pair of elongate rails, each rail having a channel defining an upper track and a channel defining a lower track, the rails being horizontally mounted in parallel spaced apart relationship on a wall surface so that one of the rails defines an upper rail and the other rail defines a lower rail;

a board; and means for movably mounting the board to the rails comprising an upper bracket secured to a top of the board and having a guide element received in the upper rail track and a lower bracket secured to a bottom of the board and having a guide element received in the lower rail track, and the system further comprising a tilt mechanism for adjusting an angle of the board relative to the wall surface.

2. The wall mounted rail system with movable boards of claim 1 wherein the tilt mechanism includes means for balancing the board at any angle of tilt.

3. The wall mounted rail system with movable boards of claim 2 wherein the balancing means comprises a spring operatively connecting the board to the mounting means.

4. The wall mounted rail system with movable boards of claim 2 wherein the balancing means comprises means for frictionally connecting the board to the mounting means.

5. A wall mounted rail system with movable boards comprising:

a pair of elongate rails, each rail having an upwardly opening channel defining an upper track and a downwardly opening channel defining a lower track, the rails being horizontally mounted in parallel spaced apart relationship on a wall surface so that one of the rails defines an upper rail and the other rail defines a lower rail;

an outer board;

means for movably mounting the outer board to the rails comprising an upper bracket secured to a top of the board and having a guide element received in the upper track of the upper rail and a lower bracket secured to a bottom of the board and having a guide element received in the lower track of the lower rail;

an inner board; and means for movably mounting the inner board to the rails comprising an upper guide element received in the lower track of the upper rail and a lower guide element received in the upper track of the lower rail so that the inner board moves independently of the outer board.

6. The wall mounted rail system with movable boards of claim 5 wherein the guide element received in a downwardly opening channel comprises a guide pin.

7. The wall mounted rail system with movable boards of claim 5 wherein the guide element received in an upwardly opening channel comprises a roller.

8. The wall mounted rail system with movable boards of claim 7 wherein the roller comprises an inner roller surrounded by a roller shell and the roller shell is rotatable independently of the inner roller.

9. The wall mounted rail system with movable boards of claim 8 wherein the inner roller contacts a horizontal surface of the track and the roller shell contacts a vertical surface of the track so that the roller shell tends to spin in a direction opposite the inner roller.

* * * * *